United States Patent [19]

Hirose

[11] Patent Number: 4,580,510

[45] Date of Patent: Apr. 8, 1986

[54] LOOPER

[75] Inventor: Tokuzo Hirose, Osaka, Japan

[73] Assignee: Hirose Manufacturing Company Limited, Osaka, Japan

[21] Appl. No.: 694,113

[22] Filed: Jan. 23, 1985

[51] Int. Cl.[4] ..... D05C 15/00

[52] U.S. Cl. ..... 112/79 R

[58] Field of Search ..... 112/79 R; 19/114

[56] References Cited

U.S. PATENT DOCUMENTS

| | | | |
|---|---|---|---|
| 3,387,338 | 6/1968 | Kanai et al. | 19/114 |
| 3,833,968 | 9/1974 | Arai et al. | 19/114 |
| 3,916,045 | 10/1975 | Ibbotson | 19/114 |
| 4,103,518 | 8/1978 | Lombardi et al. | 66/107 |
| 4,155,318 | 5/1979 | Yamamoto | 112/79 R |
| 4,237,705 | 12/1980 | Petrov | 66/123 |
| 4,274,346 | 6/1981 | Carnaby | 112/79 R |

FOREIGN PATENT DOCUMENTS

| | | | |
|---|---|---|---|
| 2823408 | 12/1978 | Fed. Rep. of Germany | 112/79 R |

*Primary Examiner*—Ronald Feldbaum

*Attorney, Agent, or Firm*—Wenderoth, Lind & Ponack

[57] ABSTRACT

A looper of a tufting machine, has a hardened metal facing coating layer which consists of titanium nitride (TiN) applied on one side or both sides thereof by means of an ion-plating method.

2 Claims, 3 Drawing Figures

LOOPER

BACKGROUND OF THE INVENTION

1. Field of the Invention

The present invention relates to a looper for a tufting machine, etc.

2. Description of the Prior Art

In FIG. 1, a conventional looper 1 of a tufting machine is shown. There is formed a projecting guide part 3 in a base 2 of the looper 1, while, there is provided a blade portion 4 on a side of the guide part 3. At the end of the guide part 3 (on the right side as viewed in FIG. 1), there is formed a thread-hook 5 which is substantially bent in the shape of a letter L. Steel is chosen as material for the looper 1. When a tufting needle (not shown) operating in the tufting machine is penetrated through a workpiece 6 such as a cloth, carpet, and the like, the thread-hook 5 is passed through a loop-shaped pile thread 7. The loop-shaped pile thread 7 is cut off by the blade portion 4 of the guide part 3 and a cutting member (not shown) abutting thereagainst to make the workpiece form piles.

In such prior art arrangement, when the looper 1 is operated continuously at high speed, the blade portion 4 is frequently broken or the looper 1 is deformed, with the result that the pile thread 7 cannot be smoothly cut.

SUMMARY OF THE INVENTION

Accordingly, in order to solve the above problems, it is an object of the invention to provide a looper of such a tufting machine which has sufficiently high durability such that it may be used for a long period of time.

To achieve the object, the looper in accordance with the invention has a hardened metal facing coating layer applied on at least one side thereof.

In a preferred embodiment, the hardened metal facing coating layer consists of titanium nitride (TiN).

Consequently, in accordance with the invention, the looper is covered with the hardened metal facing coating layer, thereby inhancing the hardness of the looper and hence the durability thereof as well. As a result, the cutting of the pile thread can be smoothly performed for a long period of time.

BRIEF DESCRIPTION OF THE DRAWINGS

These and other objects, features and advantages of the invention will become more apparent from the following detailed description taken with the accompanying drawings, in which.

DETAILED DESCRIPTION OF THE PREFERRED EMBODIMENTS

Figure 1:
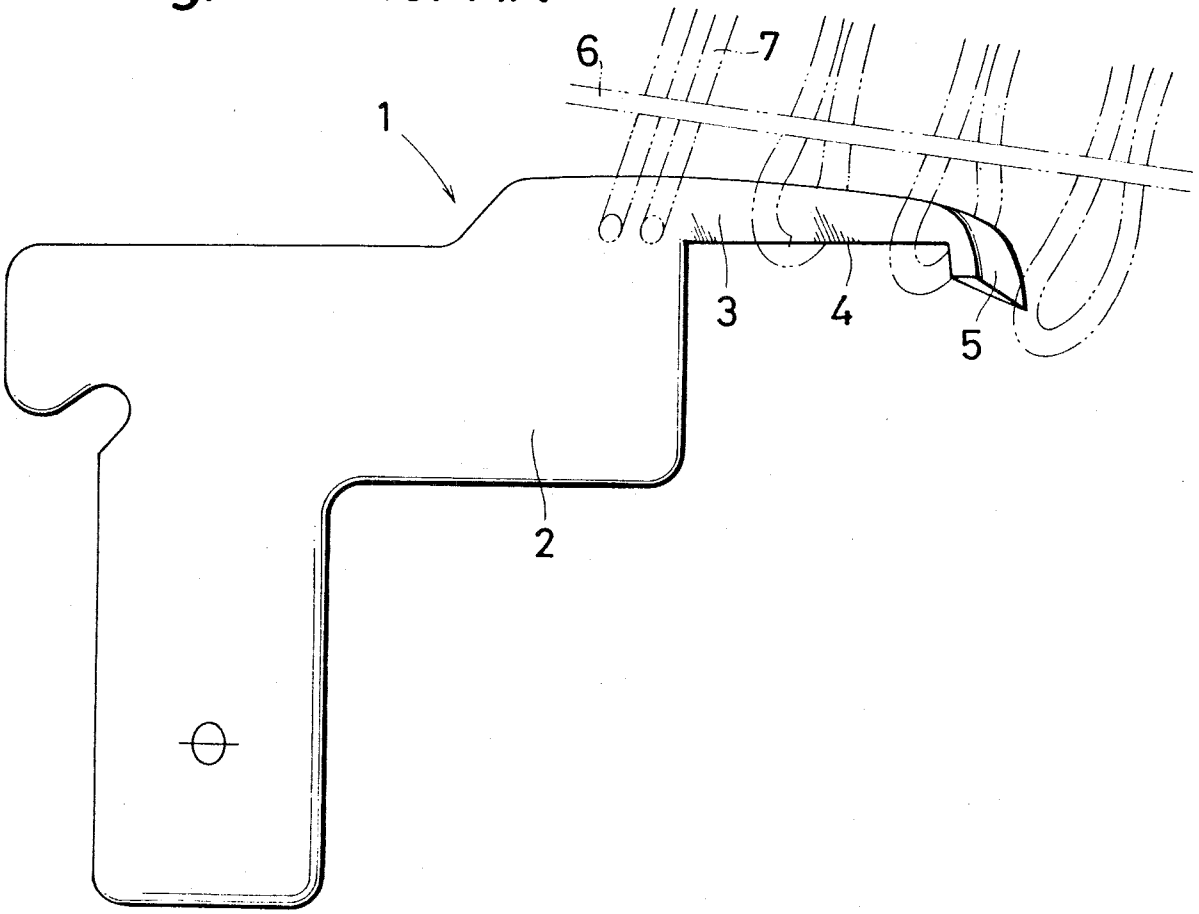
Fig. 1 Prior Art
FIG. 1 is a front view showing the looper of the prior art mentioned already.

Referring now to the drawings, embodiments of the invention are described below.

Figure 2A:
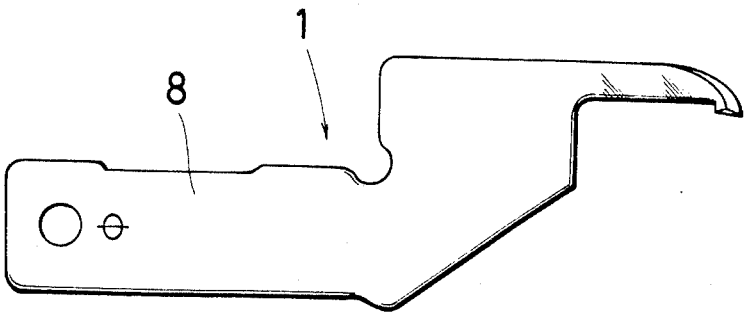
FIGS. 2*a* and 2*b* are front views showing loopers according to embodiments of the invention.
Figure 2B:
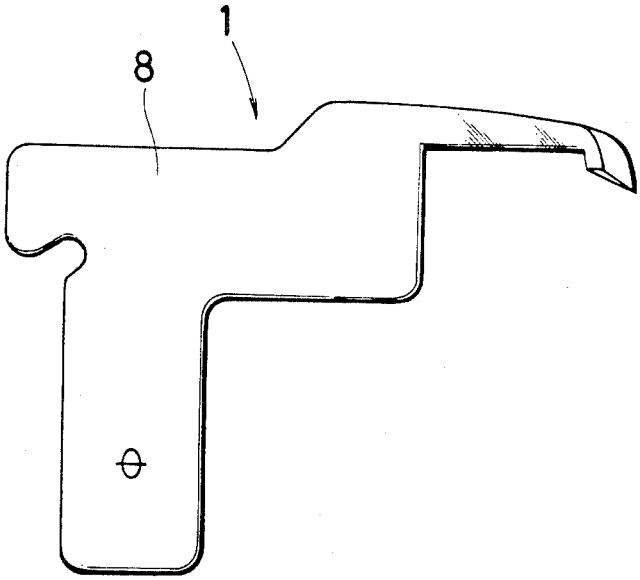

A hardened metal facing coating layer 8 is applied on each of the surfaces of loopers 1 shown in FIGS. 2*a* and 2*b*. As material for the hardened metal facing coating layer 8, titanium nitride (TiN) is suitably used. To cover the looper 1 with titanium nitride (TiN), what is called an ion-plating method is employed. Namely, titanium (Ti) is evaporated in space in which glow discharge is performed through nitrogen (N) gas, and then resultant titanium nitride (TiN) is deposited on the surface of the looper 1 charged with negative electricity, thus effecting the covering of the hardened metal facing coating layer 8.

Based on experiments carried out by the present inventor, the following advantages due to applying the hardened metal facing coating layer 8 on the looper 1 can be obtained:

(a) Hardness of the looper 1 can be increased. More particularly, when the thin film 8 consisting of titanium nitride (TiN) is 1 to 2 μm thick, the useful life of looper 1 becomes more than twice as great as that of the conventional looper, thus leading to an inhancement of durability of the looper 1.

(b) It is possible to make the hardened metal facing coating layer 8 a golden color itself. Furthermore, since the tint of the layer can be varied within the range from yellowish to reddish, it is also possible to provide a particularly desired to the inner shuttle.

(c) The heat conducting capability of the looper 1 can be improved. Consequently, since the looper 1 is easy to cool, not only the durability thereof can be further improved, but also sharpness of the blade can be maintained for a long period of time. Additionally, the shape of the looper 1 is not limited to those shown in FIGS. 2*a* and 2*b*, and the present invention is applicable to loopers of various shapes.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and the range of equivalency of the claims are therefore intended to be embraced therein.

What is claimed is:

1. A looper for use on a tufting machine, said looper having on at least one side thereof a hardened facing coating layer of titanium nitride having a thickness of 1 to 2 μm formed as a result of an ion-plating process.

2. A looper as claimed in claim 1, comprising a base member having extending therefrom a guide part having at the end thereof a hook and a blade portion between said base member and said hook, said coating layer being formed on both opposite sides of the entire said looper.

* * * * *